US009617616B2

(12) United States Patent
Imamura et al.

(10) Patent No.: US 9,617,616 B2
(45) Date of Patent: Apr. 11, 2017

(54) METHOD FOR PRODUCING GRAIN-ORIENTED ELECTRICAL STEEL SHEET

(71) Applicant: JFE STEEL CORPORATION, Tokyo (JP)

(72) Inventors: Takeshi Imamura, Kurashiki (JP); Yukihiro Shingaki, Kurashiki (JP); Makoto Watanabe, Okayama (JP); Ryuichi Suehiro, Kurashiki (JP); Toshito Takamiya, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/415,089

(22) PCT Filed: Jul. 25, 2013

(86) PCT No.: PCT/JP2013/070185
§ 371 (c)(1),
(2) Date: Jan. 15, 2015

(87) PCT Pub. No.: WO2014/017589
PCT Pub. Date: Jan. 30, 2014

(65) Prior Publication Data

US 2015/0187473 A1 Jul. 2, 2015

(30) Foreign Application Priority Data

Jul. 26, 2012 (JP) ..... 2012-165516

(51) Int. Cl.

| | |
|---|---|
| ***C21D 9/46*** | (2006.01) |
| ***C21D 8/12*** | (2006.01) |
| ***C22C 38/00*** | (2006.01) |
| ***C22C 38/60*** | (2006.01) |
| ***H01F 1/16*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/16*** | (2006.01) |
| ***C22C 38/40*** | (2006.01) |
| ***C21D 6/00*** | (2006.01) |

(Continued)

(52) U.S. Cl.

CPC ..... *C21D 9/46* (2013.01); *C21D 6/004* (2013.01); *C21D 6/005* (2013.01); *C21D 6/008* (2013.01); *C21D 8/12* (2013.01); *C21D 8/1222* (2013.01); *C21D 8/1233* (2013.01); *C21D 8/1255* (2013.01); *C21D 8/1261* (2013.01); *C21D 8/1266* (2013.01); *C21D 8/1272* (2013.01); *C21D 8/1283* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/16* (2013.01); *C22C 38/34* (2013.01); *C22C 38/40* (2013.01); *C22C 38/60* (2013.01); *H01F 1/14775* (2013.01); *H01F 1/16* (2013.01); *C21D 2201/05* (2013.01)

(58) Field of Classification Search

CPC ..... C22C 38/00; C22C 38/02; C22C 38/04; C22C 38/06

See application file for complete search history.

(56) References Cited

U.S. PATENT DOCUMENTS

| | | | | |
|---|---|---|---|---|
| 4,898,626 A | | 2/1990 | Shoen et al. | |
| 4,975,127 A | * | 12/1990 | Kurosawa | C21D 8/1244 148/111 |
| 2009/0165895 A1 | | 7/2009 | Ushigami et al. | |

(Continued)

FOREIGN PATENT DOCUMENTS

| | | |
|---|---|---|
| CN | 101454465 A | 6/2009 |
| EP | 2 213 754 A1 | 8/2010 |

(Continued)

OTHER PUBLICATIONS

Human English Translation of JP S 63-105926A of Iwamoto et al. dated May 11, 1988.*

(Continued)

*Primary Examiner* — Roy King
*Assistant Examiner* — Jophy S Koshy
(74) *Attorney, Agent, or Firm* — Oliff PLC

(57) ABSTRACT

In a method for producing a grain-oriented electrical steel sheet by comprising a series of steps of hot rolling a raw steel material containing C: 0.002-0.10 mass %, Si: 2.0-8.0 mass % and Mn: 0.005-1.0 mass % to obtain a hot rolled sheet, subjecting the hot rolled steel sheet after or without hot band annealing to one stage cold rolling or two or more stage cold rollings including an intermediate annealing therebetween to obtain a cold rolled sheet having a final sheet thickness, subjecting the cold rolled sheet to decarburization annealing combined with primary recrystallization annealing, applying an annealing separator to the steel sheet surface and then subjecting to a final annealing, when rapid heating is performed at a rate of not less than 50° C./s in a range of 200-700° C. of the decarburization annealing, the cold rolled sheet is subjected to holding at any temperature of 250-600° C. for 1-10 seconds thereof to thereby produce a grain-oriented electrical steel sheet being low in the iron loss and small in the deviation of the iron loss value.

6 Claims, 2 Drawing Sheets

(51) Int. Cl.
*C22C 38/34* (2006.01)
*H01F 1/147* (2006.01)

(56) References Cited

U.S. PATENT DOCUMENTS

| | | | |
|---|---|---|---|
| 2015/0170813 | A1 | 6/2015 | Shingaki et al. |
| 2016/0319390 | A1 | 11/2016 | Imamura et al. |

FOREIGN PATENT DOCUMENTS

| | | | |
|---|---|---|---|
| JP | S63-105926 | A | 5/1988 |
| JP | H07-062436 | A | 3/1995 |
| JP | H07-62437 | A | 3/1995 |
| JP | H07-312306 | A | 11/1995 |
| JP | H10-130729 | A | 5/1998 |
| JP | H10-298653 | A | 11/1998 |
| JP | 2000-204450 | A | 7/2000 |
| JP | 2003-027194 | A | 1/2003 |
| JP | 2008-001979 | A | 1/2008 |
| JP | 2008-001983 | A | 1/2008 |
| JP | 2008-266727 | A | 11/2008 |
| JP | 2013-047383 | A | 3/2013 |
| JP | 2013-139629 | A | 7/2013 |

OTHER PUBLICATIONS

Oct. 15, 2013 International Search Report issued in International Application No. PCT/JP2013/070185.
Aug. 31, 2015 Office Action issued in corresponding Chinese Patent Application No. 201380038008.0 (Translation Only).
Feb. 17, 2016 Extended European Search Report in European Patent Application No. 13822382.1.
Mar. 30, 2016 Office Action issued in Chinese Patent Application No. 201380038008.0.
Jan. 27, 2015 International Preliminary Report on Patentability issued in Application No. PCT/JP2013/070187.
Shiraiwa et al, Recrystallization Process of Al-Killed Steel during Isothermal Annealing, 1971, pp. 20-28.
Sep. 21, 2015 Office Action issued in Chinese Application No. 201380037789.1.
Jan. 29, 2016 Search Report issued in European Application No. 13823812.6.
Oct. 1, 2015 Office Action issued in U.S. Appl. No. 14/415,027.
Apr. 7, 2016 Office Action issued in U.S. Appl. No. 14/415,027.
Sep. 29, 2016 Office Action issued in U.S. Appl. No. 14/415,027.
Jan. 12, 2017 Office Action Issued in U.S Appl. No. 15/208,720.
Jan. 13, 2017 Office Action issued in U.S. Appl. No. 14/414,623.
Oct. 15, 2013 International Search Report issued in International Application No. PCT1JP20131070186.
Feb. 23, 2016 Office Action issued in Korean Application No. 2015-7000715.
Oct. 15, 2013 International Search Report issued in International Application No. PCT/JP2013/070187.

* cited by examiner

METHOD FOR PRODUCING GRAIN-ORIENTED ELECTRICAL STEEL SHEET

TECHNICAL FIELD

This invention relates to a method for producing a grain-oriented electrical steel sheet, and more particularly to a method for producing a grain-oriented electrical steel sheet which is low in the iron loss and small in the magnetic property deviation.

RELATED ART

The electrical steel sheets are soft magnetic materials widely used as iron cores for transformers, motors or the like. Among them, the grain-oriented electrical steel sheets are excellent in the magnetic properties because their grain orientations are highly accumulated into {110}<001> orientation called as Goss orientation, so that they are mainly used as iron cores for large-size transformers or the like. In order to decrease no-load loss (energy loss) in the transformer, the iron loss is required to be low. As a method for decreasing the iron loss in the grain-oriented electrical steel sheet, it is known that the increase of Si content, the decrease of sheet thickness, the high accumulation of grain orientations into Goss orientation, the application of high tension to steel sheet, the smoothening of steel sheet surface, the refining of secondary recrystallized grains or the like are effective.

As a technique for refining secondary recrystallized grains among these methods is proposed a method wherein the steel sheet is subjected to a heat treatment by rapid heating in decarburization annealing or rapid heating just before decarburization annealing to improve primary recrystallized texture. For example, Patent Document 1 discloses a technique of obtaining a grain-oriented electrical steel sheet with a low iron loss wherein a cold rolled steel sheet with a final thickness is rapidly heated to a temperature of not lower than 700° C. at a rate of not less than 100° C./s in a non-oxidizing atmosphere having $P_{H2O}/P_{H2}$ of not more than 0.2 during decarburization annealing. Also, Patent Document 2 discloses a technique wherein a grain-oriented electrical steel sheet with a low iron loss is obtained by rapidly heating a steel sheet to 800-950° C. at a heating rate of not less than 100° C./s while an oxygen concentration in the atmosphere is set to not more than 500 ppm and subsequently keeping the steel sheet at a temperature of 775-840° C. lower than the temperature of the rapid heating and further keeping the steel sheet at a temperature of 815-875° C. Further, Patent Document 3 discloses a technique wherein an electrical steel sheet having excellent coating properties and magnetic properties is obtained by heating steel sheet from not lower than 600° C. to not lower than 800° C. at a heating rate of not less than 95° C./s with properly controlling the atmosphere in such a temperature region. In addition, Patent Document 4 discloses a technique wherein a grain-oriented electrical steel sheet with a low iron loss is obtained by limiting N content as AlN precipitates in the hot rolled steel sheet to not more than 25 ppm and heating to not lower than 700° C. at a heating rate of not less than 80° C./s during decarburization annealing.

In these techniques of improving the primary recrystallized texture by rapid heating, the temperature range for rapid heating is from room temperature to not lower than 700° C. and also the heating rate is defined unambiguously. Such a technical idea is attempted to improve the primary recrystallized texture by raising the temperature close to a recrystallization temperature in a short time to suppress development of γ-fiber (<111>/ND orientation), which is preferentially formed at a common heating rate, and to promote the generation of {110}<001> structure as a grain nucleus for secondary recrystallization. It is known that crystal grains with Goss orientation after the secondary recrystallization are refined by applying these techniques to improve the iron loss property.

PRIOR ART DOCUMENTS

Patent Documents

Patent Document 1: JP-A-H07-062436
Patent Document 2: JP-A-H10-298653
Patent Document 3: JP-A-2003-027194
Patent Document 4: JP-A-H10-130729

SUMMARY OF THE INVENTION

Task to be Solved by the Invention

According to the inventors' knowledge, however, when the heating rate becomes high, the deviation of the iron loss property resulting from temperature variation inside the steel sheet in heating becomes large. In the evaluation of iron loss before shipping the product, an average value of iron loss values over the full width of the steel sheet is generally used. However, if the iron loss deviation is large, the average value of iron loss values over the full width of the steel sheet becomes high as compared to that in best site, and hence the desired effect by the rapid heating is not obtained.

The invention is made in view of the above problems inherent to the conventional techniques and is to propose a method for producing a grain-oriented electrical steel sheet, which is lower in the iron loss and smaller in the deviation of iron loss values as compared with those of the conventional techniques, by properly adjusting a heating pattern during decarburization annealing.

Solution for Task

The inventors have made various studies for solving the above task. As a result, it has been found that when the rapid heating is performed during the decarburization annealing and the temperature is kept at around a recovery temperature region for a given time, the temperature inside the steel sheet is uniformized to provide the effect of the rapid heating over the full width of the steel sheet, while <111>/ND orientation is preferentially recovered to decrease <111>/ND orientation after the primary recrystallization and to increase nuclei of Goss orientation instead. Thereby recrystallized grains after the secondary recrystallization become more refined, and hence grain-oriented electrical steel sheet being low in the iron loss and small in the deviation of iron loss values can be obtained, and the invention has been accomplished.

That is, the invention is a method for producing a grain-oriented electrical steel sheet by comprising a series of steps of hot rolling a raw steel material comprising C: 0.002-0.10 mass %, Si: 2.0-8.0 mass %, Mn: 0.005-1.0 mass %, Al: 0.010-0.050 mass % and N: 0.003-0.020 mass % or Al: 0.010-0.050 mass % and N: 0.003-0.020 mass %, Se: 0.003-0.030 mass % and/or S: 0.002-0.03 mass % and the remainder being Fe and inevitable impurities to obtain a hot rolled sheet, subjecting the hot rolled steel sheet after or without annealing to one stage cold rolling or two or more stage cold rollings including an intermediate annealing therebetween to obtain a cold rolled sheet having a final sheet thickness, subjecting the cold rolled sheet to decarburization annealing combined with primary recrystallization annealing, applying an annealing separator to the steel sheet surface and then subjecting to a final annealing, characterized in that when rapid heating is performed at a rate of not less than 50° C./s in a range of 200-700° C. of the decarburization annealing, the cold rolled sheet is subjected to holding at any temperature of 250-600° C. for 1-10 seconds thereof.

Also, the invention is a method for producing a grain-oriented electrical steel sheet by comprising a series of steps of hot rolling a raw steel material comprising C: 0.002-0.10 mass %, Si: 2.0-8.0 mass %, Mn: 0.005-1.0 mass %, one or two selected from Se: 0.003-0.030 mass % and S: 0.002-0.03 mass % and the remainder being Fe and inevitable impurities to obtain a hot rolled sheet, subjecting the hot rolled steel sheet after or without annealing to one stage cold rolling or two or more stage cold rollings including an intermediate annealing therebetween to obtain a cold rolled sheet having a final sheet thickness, subjecting the cold rolled sheet to decarburization annealing combined with primary recrystallization annealing, applying an annealing separator to the steel sheet surface and then subjecting to a final annealing, characterized in that when rapid heating is performed at a rate of not less than 50° C./s in a range of 200-700° C. of the decarburization annealing, the cold rolled sheet is subjected to holding at any temperature of 250-600° C. for 1-10 seconds thereof.

Further, the invention is a method for producing a grain-oriented electrical steel sheet by comprising a series of steps of hot rolling a raw steel material comprising C: 0.002-0.10 mass %, Si: 2.0-8.0 mass %, Mn: 0.005-1.0 mass %, Al: less than 0.01 mass %, N: less than 0.0050 mass %, Se: less than 0.0030 mass % and S: less than 0.0050 mass % and the remainder being Fe and inevitable impurities to obtain a hot rolled sheet, subjecting the hot rolled steel sheet after or without annealing to one stage cold rolling or two or more stage cold rollings including an intermediate annealing therebetween to obtain a cold rolled sheet having a final sheet thickness, subjecting the cold rolled sheet to decarburization annealing combined with primary recrystallization annealing, applying an annealing separator to the steel sheet surface and then subjecting to a final annealing, characterized in that when rapid heating is performed at a rate of not less than 50° C./s in a range of 200-700° C. of the decarburization annealing, the cold rolled sheet is subjected to holding at any temperature of 250-600° C. for 1-10 seconds thereof.

In the invention, the raw steel material is characterized by containing one or more selected from Ni: 0.010-1.50 mass %, Cr: 0.01-0.50 mass %, Cu: 0.01-0.50 mass %, P: 0.005-0.50 mass %, Sb: 0.005-0.50 mass %, Sn: 0.005-0.50 mass %, Bi: 0.005-0.50 mass %, Mo: 0.005-0.100 mass %, B: 0.0002-0.0025 mass %, Te: 0.0005-0.0100 mass %, Nb: 0.0010-0.0100 mass %, V: 0.001-0.010 mass % and Ta: 0.001-0.010 mass % in addition to the above chemical composition.

Effect of the Invention

According to the invention, grain-oriented electrical steel sheets being low in the iron loss and small in the deviation of iron loss values can be provided by holding the steel sheet in a temperature zone causing the recovery for a given time when rapid heating is performed in the decarburization annealing.

EMBODIMENTS FOR CARRYING OUT THE INVENTION

Experiments building a momentum for developing the invention will be described below.

Experiment 1

A steel material containing C: 0.065 mass %, Si: 3.44 mass % and Mn: 0.08 mass % is melted and continuously cast into a steel slab, which is hot rolled after reheating at 1410° C. to obtain a hot rolled sheet of 2.4 mm in thickness. The hot rolled sheet is annealed at 1050° C. for 60 seconds, subjected to a primary cold rolling to an intermediate thickness of 1.8 mm and further to an intermediate annealing at 1120° C. for 80 seconds and then warm-rolled at 200° C. to obtain a cold rolled sheet having a final sheet thickness of 0.27 mm.

Figure 1:
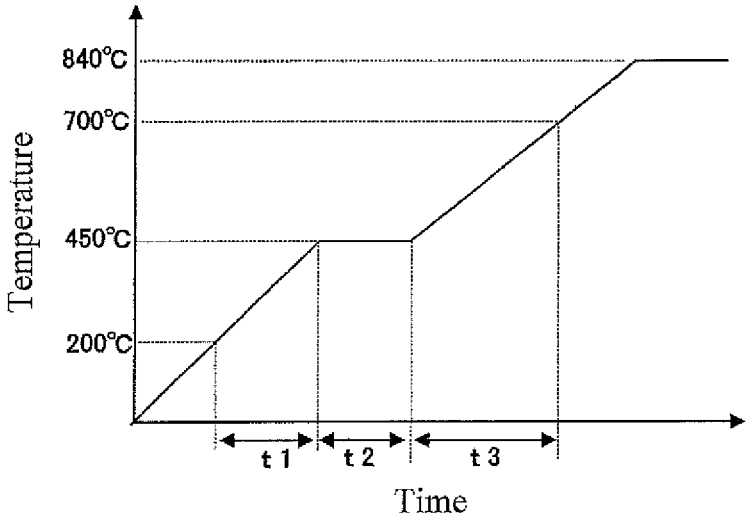
FIG. 1 is a view illustrating a heating pattern in decarburization annealing according to the invention.

Next, the cold rolled sheet is subjected to decarburization annealing combined with primary recrystallization annealing in a wet atmosphere of 50 vol % $H_2$—50 vol % $N_2$ at 840° C. for 80 seconds. The decarburization annealing is performed by setting a heating rate from 200° C. to 700° C. in the heating process up to 840° C. to 100° C./s and further holding at 450° C. for 0-30 seconds on the way of the heating. The heating rate of 100° C./s means an average heating rate defined as $((700-200)/(t_1+t_3))$ in which $t_1$ and $t_3$ are obtained by subtracting a holding time $t_2$ from a time reaching from 200° C. to 700° C. as shown in FIG. 1 (the same manner, also down below). Thereafter, the steel sheet is coated with an annealing separator composed mainly of MgO, dried and subjected to final annealing including a secondary recrystallization annealing and a purifying treatment of 1200° C.×7 hours in a hydrogen atmosphere.

Figure 2:
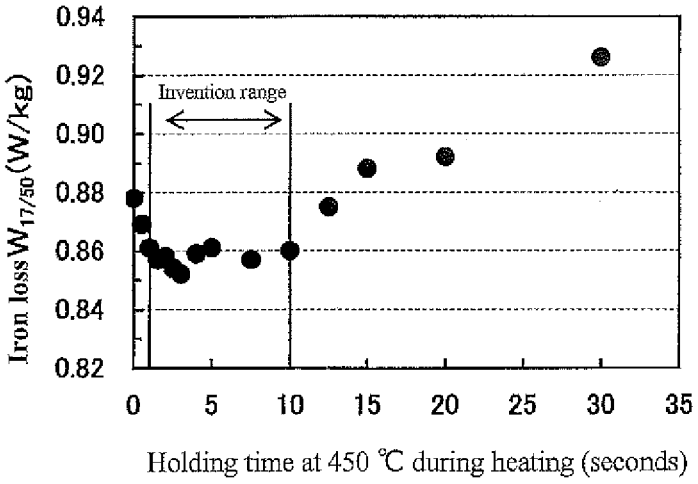
FIG. 2 is a graph showing an influence of a holding time on the way of heating upon iron loss.

From the product sheet thus obtained are cut out 10 specimen with 100 mm in width in the widthwise direction of the steel sheet under each condition, and their iron losses $W_{17/50}$ are measured by the method described in JIS C2556 and an average value thereof is determined. According to iron loss evaluation, if there is a deviation of the iron loss in the widthwise direction and the average value is deteriorated, it can be seen that the iron loss can be evaluated including the deviation. The average iron loss values are shown in FIG. 2 in relation to the holding time at 450° C. As seen from this result, the iron loss is reduced when the holding time is in a range of 1-10 seconds.

Experiment 2

The cold rolled sheet obtained in Experiment 1 and having a final thickness of 0.27 mm is subjected to a decarburization annealing in a wet atmosphere of 50 vol % $H_2$—50 vol % $N_2$ at 840° C. for 80 seconds. The heating rate in the decarburization annealing is set to 100° C./s and further holding at any temperature within a range of 200-700° C. once for 2 seconds in the heating process is performed. Thereafter, the steel sheet is coated with an annealing separator composed mainly of MgO, dried and subjected to a final annealing including a secondary recrystallization annealing and a purifying treatment of 1200° C.×7 hours in a hydrogen atmosphere.

Figure 3:
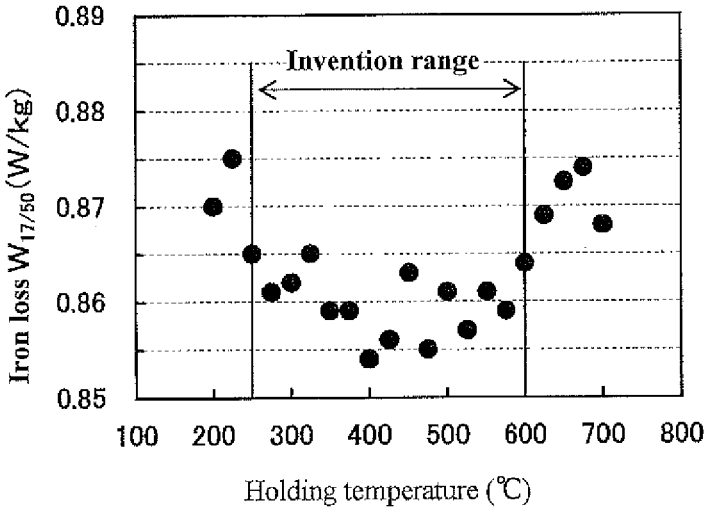
FIG. 3 is a graph showing an influence of a holding temperature on the way of heating upon iron loss.

A specimen is cut out from the product sheet thus obtained as in Experiment 1 to determine an average iron loss value $W_{17/50}$ by a method described in JIS C2556. The average iron loss values are shown in FIG. 3 in a relation to the holding temperature. As seen from this result, the iron loss is reduced when the holding temperature is in a range of 200-700° C.

Although the reason why the iron loss is reduced by holding in the heating process during the decarburization annealing at a suitable temperature for a suitable time as in Experiments 1 and 2 is not clear sufficiently, the inventors think as follows:

The rapid heating treatment has an effect of suppressing the development of <111>/ND orientation in the recrystallization texture. In general, a great deal of strain is introduced into <111>/ND orientation during the cold rolling before the recrystallization, so that the strain energy stored is higher compared to those in the other orientations. Therefore, when the decarburization annealing is performed at a usual heating rate, the recrystallization preferentially occurred from the rolled texture of <111>/ND orientation with a high strain energy stored. Since grains of <111>/ND orientation are produced from the rolled texture of <111>/ND orientation by the recrystallization, <111>/ND orientation becomes a main component in the recrystallization texture. However, when the rapid heating is performed, a greater amount of heat energy is applied compared to the energy releasable by recrystallization, whereby the recrystallization can occur even in other orientations with the relatively low strain energy stored, so that <111>/ND orientation after the recrystallization is relatively decreased. This is a reason for performing the rapid heating of the conventional technique.

If holding for the suitable time and temperature is performed at around the recovery temperature on the way of the rapid heating, a preferential recovery of <111>/ND orientation having a high strain energy proceeds. Thus, the driving force causing the recrystallization of <111>/ND orientation in the rolled texture of <111>/ND orientation decreases selectively, and consequently other orientations recrystallize, whereby <111>/ND orientation after the recrystallization further decreases. However, when the holding time exceeds 10 seconds, the recovery proceeds over a wide range and the recovered microstructure remains as it is to form a microstructure different from the primary recrystallized microstructure. The resultant recovery remaining microstructure is considered to largely exert a bad influence on the secondary recrystallization, leading to the deterioration of the iron loss property.

According to the above idea, the improvement of magnetic properties by holding at around the recovery temperature for a short time on the way of the heating is limited to a case that a heating rate is faster than the common heating rate (10-20° C./s) using the conventional radiant tube or the like, concretely a heating rate is not less than 50° C./s. In the invention, therefore, the heating rate within a temperature range of 200-700° C. in the decarburization annealing is defined to not less than 50° C./s.

There will be described a preferable chemical composition of a raw steel material (slab) applied to the grain-oriented electrical steel sheet of the present invention.

C: 0.002-0.10 Mass %

When C content is less than 0.002 mass %, the effect of reinforcing grain boundary through C is lost to cause a production blocking defects such as cracks in a slab. On the other hand, when it exceeds 0.10 mass %, it is difficult by the decarburization annealing to decrease the C content to not more than 0.005 mass %, in which magnetic aging does not occur. Therefore, the C content is preferably in a range of 0.002-0.10 mass %, more preferably in a range of 0.010-0.080 mass %.

Si: 2.0-8.0 Mass %

Si is an element required for enhancing a specific resistance of steel to reduce an iron loss. When the content is less than 2.0 mass %, the above effect is not sufficient, while when it exceeds 8.0 mass %, the workability is deteriorated and it is difficult to roll the material for the production. Therefore, the Si content is preferably in a range of 2.0-8.0 mass %, more preferably in a range of 2.5-4.5 mass %.

Mn: 0.005-1.0 Mass %

Mn is an element required for improving hot workability of steel. When the content is less than 0.005 mass %, the above effect is not sufficient, while when it exceeds 1.0 mass %, a magnetic flux density of a product sheet is lowered. Therefore, the Mn content is preferably in a range of 0.005-1.0 mass %, more preferably in a range of 0.02-0.20 mass %.

As for the chemical components other than Si, C and Mn, in order to generate the secondary recrystallization, the chemical components are classified into a case utilizing an inhibitor and a case utilizing no inhibitor.

At first, when an inhibitor is utilized for generating the secondary recrystallization, for example, when an AlN based inhibitor is utilized, Al and N are preferable to be contained in amounts of Al: 0.010-0.050 mass % and N: 0.003-0.020 mass %, respectively. When a MnS/MnSe based inhibitor is utilized, it is preferable to contain the aforementioned amount of Mn and one or two of S: 0.002-0.030 mass % and Se: 0.003-0.030 mass %. When the addition amount of each of the respective elements is less than the lower limit, the inhibitor effect is not obtained sufficiently, while when it exceeds the upper limit, the inhibitor components are retained as a non solid solute state during the reheating of the slab to bring about the deterioration of the magnetic properties. Moreover, the AlN based inhibitor and the MnS/MnSe based inhibitor may be used together.

On the other hand, when an inhibitor is not utilized for generating the secondary recrystallization, the contents of Al, N, S and Se discussed as an inhibitor forming components are decreased as much as possible, and it is preferable to use a raw steel material containing Al: less than 0.01 mass %, N: less than 0.0050 mass %, S: less than 0.0050 mass % and Se: less than 0.0030 mass %.

The remainder other than the above components in the grain-oriented electrical steel sheet is Fe and inevitable impurities. However, one or more selected from Ni: 0.001-0.015 mass %, Sb: 0.005-0.50 mass %, Sn: 0.005-0.50 mass %, Bi: 0.005-0.50 mass %, Mo: 0.005-0.100 mass %, B: 0.0002-0.0025 mass %, Te: 0.0005-0.010 mass %, Nb: 0.0010-0.010 mass %, V: 0.001-0.010 mass % and Ta: 0.001-0.010 mass % may be added properly for the purpose of improving the magnetic properties.

The method for producing the grain-oriented electrical steel sheet of the invention will be described below.

After a steel having the aforementioned chemical composition is melted by a usual refining process, a raw steel material (slab) may be produced by the conventionally well-known ingot making-blooming method or continuous casting method, or a thin cast slab having a thickness of not more than 100 mm may be produced by a direct casting method. The slab is heated according to the usual manner, for example, to about 1400° C. in case of containing the inhibitor components or to a temperature of not higher than 1250° C. in case of containing no inhibitor component and then subjected to hot rolling. Moreover, when the inhibitor components are not contained, the slab may be hot rolled without heating immediately after the casting. Also, the thin cast slab may be hot rolled or may be forwarded to subsequent steps with the omission of the hot rolling.

Then, the hot rolled sheet may be subjected to a hot band annealing, if necessary. The temperature of the hot band annealing is preferable to be in a range of 800-1150° C. in order to obtain good magnetic properties. When it is lower than 800° C., a band structure formed by the hot rolling is retained, so that it is difficult to obtain primary recrystallized structure of uniformly sized grains and the development of the secondary recrystallization is obstructed. While, when it exceeds 1150° C., the grain size after the hot band annealing becomes excessively coarsened, and hence it is difficult to obtain primary recrystallized structure of uniformly sized grains.

The hot rolled sheet after the hot rolling or after the hot band annealing is subjected to one stage cold rolling or two or more stage cold rollings with an intermediate annealing therebetween to obtain a cold rolled sheet having a final thickness. The annealing temperature of the intermediate annealing is preferable to be in a range of 900-1200° C. When the temperature is lower than 900° C., the recrystallized gains after the intermediate annealing becomes finer and further Goss nuclei in the primary recrystallized structure are decreased, so that magnetic properties of a product sheet deteriorate. While, when it exceeds 1200° C., the crystal grains become excessively coarsened as in the hot band annealing and it is difficult to obtain primary recrystallized structure uniformly sized grains.

Moreover, it is effective to perform the cold rolling for providing the final thickness by raising the steel sheet temperature in the cold rolling to 100-300° C. or by conducting one or more aging treatments at a temperature of 100-300° C. on the way of the cold rolling in order to improve the primary recrystallized texture and to improve the magnetic properties.

Thereafter, the cold rolled sheet having a final thickness is subjected to decarburization annealing combined with primary recrystallization annealing. In the decarburization annealing, the annealing temperature is preferable to be in a range of 800-900° C. and the atmosphere is preferable to be a wet atmosphere from a viewpoint of the decarburization. However, they are not critical in case of using a raw steel material having only a C content of not more than 0.005 mass %, which is not necessary to conduct the decarburization. Moreover, the primary recrystallization annealing may be carried out separately aside from the decarburization annealing.

In the invention, it is important that rapid heating of not less than 50° C./s is performed in the range of 200-700° C. in the heating process of the decarburization annealing and that holding at any temperature of 250-600° C. for 1-10 seconds is required.

The heating rate in the range of 200-700° C. (not less than 50° C./s) is the heating rate calculated against the heating time from which holding time is subtracted as previously mentioned.

Holding 250-600° C. may be conducted at any temperature of the above temperature range, and the temperature is not necessarily constant. When the temperature is raised at a low rate of not more than 10° C./s, the effect similar to the holding case can be obtained, so that the heating at a low rate of not more than 10° C./s may be used.

Thereafter, when a forsterite coating is formed with the emphasis on the iron loss property, the steel sheet subjected to the decarburization annealing is coated on its surface with an annealing separator composed mainly of MgO and is dried and then further subjected to final annealing, whereby a secondary recrystallized texture highly accumulated in Goss orientation is developed and a forsterite coating is formed. On the other hand, when a forsterite coating is not formed with the emphasis on the punching workability, it is preferable that the above annealing separator is not used or the final annealing is performed with an annealing separator composed mainly of silica, alumina or the like. Moreover, electrostatic application without water content is effective as the application of the annealing separator in case of forming no forsterite coating. A heat-resistant inorganic material sheet (silica, alumina, mica) may be used instead of the latter annealing separator.

In case of forming the forsterite coating, it is preferable that the annealing temperature of the final annealing is not lower than 800° C. for developing the secondary recrystallization and also the temperature of not lower than 800° C. is kept for not less than 20 hours for completing the secondary recrystallization. In case of forming no forsterite coating, it is enough to complete the secondary recrystallization, so that the annealing temperature is preferably in a range of 850-950° C., and it is possible to end the final annealing by keeping only this temperature zone for not less than several hours. Moreover, when a purification treatment is performed with the emphasis on the iron loss property or when a forsterite coating is formed for lowering noise of a transformer, it is preferable to raise the temperature to about 1200° C.

The steel sheet after the final annealing is then subjected to washing with water, brushing, pickling or the like for removing the unreacted annealing separator attached to the surface of the steel sheet, and thereafter subjected to a flattening annealing to conduct configuration correction, which is effective for reducing the iron loss. This is due to the fact that since the final annealing is generally conducted at a coiling state, a wound habit is applied to the sheet and may deteriorate the properties in the measurement of the iron loss. Further, if the steel sheets are used at a laminated state, it is effective to apply an insulation coating onto the surface of the steel sheet before or after the flattening annealing. Especially, it is preferable to apply a tension-imparted coating to the steel sheet as the insulation coating for the purpose of reducing the iron loss. Moreover, in order to form the tension-imparted coating, it is preferable to adopt a method of applying the tension coating through a binder or a method of depositing an inorganic matter onto a surface layer of the steel sheet with physical vapor deposition or chemical vapor deposition process because these methods can form an insulation coating having an excellent adhesion property and a considerably large effect of reducing the iron loss.

In order to further reduce the iron loss, it is preferable to conduct magnetic domain refining treatment. As such a treating method can be used a method of forming grooves in a final product sheet as being generally performed, a method of introducing linear or dotted heat strain or impact strain through laser irradiation, electron beam irradiation or plasma irradiation, a method of forming grooves in a surface of a steel sheet after middle step such as a steel sheet cold rolled to a final thickness or the like through etching, and so on.

Example 1

A steel slab comprising C: 0.070 mass %, Si: 3.35 mass %, Mn: 0.10 mass %, Al: 0.025 mass %, Se: 0.025 mass %, N: 0.012 mass % and the remainder being Fe and inevitable impurities is manufactured by a continuous casting method, heated to a temperature of 1420° C., and then hot rolled to 2.4 mm in thickness. The hot rolled sheet is annealed at 1000° C. for 50 seconds, subjected to a first cold rolling to an intermediate thickness of 1.8 mm, annealed at 1100° C. for 20 seconds and then subjected to a second cold rolling to obtain a cold rolled sheet having a final thickness of 0.27 mm.

Thereafter, the cold rolled sheet is subjected to decarburization annealing in a wet atmosphere of 50 vol % $H_2$—50 vol % $N_2$ at 840° C. for 100 seconds. In this case, a heating rate in a zone of 200-700° C. during the heating process up to 850° C. is changed as shown in Table 1, while for the temperature and time shown in Table 1 holding on the way of the heating is performed.

Then, the steel sheet is coated on its surface with an annealing separator composed mainly of MgO, dried and subjected to final annealing combined with a purification treatment at 1200° C. for 10 hours. The atmosphere of the final annealing is $H_2$ in the keeping of 1200° C. for the purification treatment, and $N_2$ in the heating and cooling.

TABLE 1

| | Heating conditions of decarburization annealing | | | | | |
|---|---|---|---|---|---|---|
| | Heating rate | Holding treatment | | | Iron | |
| No. | from 200° C. to 700° C. (° C./s) | Presence or absence of holding | Holding temperature (° C.) | Holding time (s) | loss $W_{17/50}$ (W/kg) | Remarks |
| 1 | 10 | absence | — | — | 0.901 | Comparative Example |
| 2 | 10 | presence | 400 | 3 | 0.911 | Comparative Example |
| 3 | 25 | absence | — | — | 0.892 | Comparative Example |
| 4 | 25 | presence | 200 | 3 | 0.890 | Comparative Example |
| 5 | 25 | presence | 400 | 3 | 0.901 | Comparative Example |
| 6 | 25 | presence | 600 | 3 | 0.956 | Comparative Example |
| 7 | 50 | absence | — | — | 0.877 | Comparative Example |
| 8 | 50 | presence | 200 | 3 | 0.882 | Comparative Example |
| 9 | 50 | presence | 400 | 3 | 0.863 | Invention Example |
| 10 | 50 | presence | 600 | 3 | 0.865 | Invention Example |
| 11 | 100 | absence | — | — | 0.874 | Comparative Example |
| 12 | 100 | presence | 200 | 3 | 0.875 | Comparative Example |
| 13 | 100 | presence | 250 | 3 | 0.859 | Invention Example |
| 14 | 100 | presence | 300 | 3 | 0.855 | Invention Example |
| 15 | 100 | presence | 400 | 0.5 | 0.875 | Comparative Example |
| 16 | 100 | presence | 400 | 1 | 0.851 | Invention Example |
| 17 | 100 | presence | 400 | 2 | 0.861 | Invention Example |
| 18 | 100 | presence | 400 | 3 | 0.859 | Invention Example |
| 19 | 100 | presence | 400 | 5 | 0.854 | Invention Example |
| 20 | 100 | presence | 400 | 10 | 0.866 | Invention Example |
| 21 | 100 | presence | 400 | 20 | 0.922 | Comparative Example |
| 22 | 100 | presence | 400 | 60 | 0.970 | Comparative Example |
| 23 | 100 | presence | 500 | 3 | 0.857 | Invention Example |
| 24 | 100 | presence | 600 | 3 | 0.857 | Invention Example |
| 25 | 100 | presence | 650 | 3 | 0.888 | Comparative Example |
| 26 | 200 | absence | — | — | 0.870 | Comparative Example |
| 27 | 200 | presence | 200 | 3 | 0.879 | Comparative Example |
| 28 | 200 | presence | 400 | 3 | 0.863 | Invention Example |
| 29 | 200 | presence | 600 | 3 | 0.859 | Invention Example |

From the steel sheet obtained after the final annealing as mentioned above are cut out 10 specimens with a width of 100 mm in a widthwise direction of the steel sheet under each condition and their iron losses $W_{17/50}$ are measured by a method described in JIS C2556 to determine an average value thereof. The results are also shown in Table 1. As seen from this table, grain-oriented electrical steel sheets being low in the iron loss are obtained by applying the invention.

Example 2

A steel slab having a chemical composition shown in Table 2 and comprising the remainder being Fe and inevitable impurities is manufactured by a continuous casting method, heated to a temperature of 1380° C. and hot rolled to obtain a hot rolled sheet of 2.0 mm in thickness. The hot rolled sheet is annealed at 1030° C. for 10 seconds and cold rolled to 0.23 mm. Thereafter, the cold rolled sheet is subjected to decarburization annealing combined with primary recrystallization annealing in a wet atmosphere of 50 vol % $H_2$—50 vol % $N_2$ at 840° C. for 60 seconds. In this case, a heating rate in a range of 200-700° C. during the heating process up to 840° C. is 75° C./s, and a temperature of 450° C. is hold for 1.5 seconds on the way of the heating.

Then, the steel sheet is coated on its surface with an annealing separator composed mainly of MgO, dried and subjected to final annealing combined with a purification treatment at 1220° C. for 4 hours. The atmosphere of the final annealing is $H_2$ in the holding of 1220° C. for the purification treatment, and Ar in the heating and cooling.

TABLE 2

| No. | Chemical composition (mass %) C | Si | Mn | Al | N | Se | S | others | Iron loss $W_{17/50}$ (W/kg) | Remarks |
|---|---|---|---|---|---|---|---|---|---|---|
| 1 | 0.055 | 3.25 | 0.06 | — | — | — | — | — | 0.855 | Invention Example |
| 2 | 0.044 | 3.38 | 0.15 | 0.007 | 0.003 | — | 0.002 | — | 0.842 | Invention Example |
| 3 | 0.078 | 3.41 | 0.08 | 0.021 | 0.008 | 0.015 | 0.002 | — | 0.808 | Invention Example |
| 4 | 0.222 | 3.22 | 0.15 | — | — | — | — | — | 1.556 | Comparative Example |
| 5 | 0.052 | 0.85 | 0.16 | — | — | — | — | — | 1.020 | Comparative Example |
| 6 | 0.053 | 3.25 | 1.51 | — | — | — | — | — | 1.003 | Comparative Example |
| 7 | 0.050 | 3.25 | 0.08 | — | — | 0.020 | — | — | 0.854 | Inventione Example |
| 8 | 0.040 | 3.25 | 0.07 | — | — | 0.020 | 0.005 | Sb: 0.025 | 0.842 | Invention Example |
| 9 | 0.066 | 2.84 | 0.11 | 0.019 | 0.008 | 0.012 | — | Sb: 0.022, Cu: 0.11, P: 0.009 | 0.839 | Invention Example |
| 10 | 0.041 | 3.01 | 0.05 | 0.011 | 0.006 | — | 0.004 | Ni: 0.20, Cr: 0.05, Sb: 0.02, Sn: 0.05 | 0.822 | Invention Example |
| 11 | 0.006 | 3.20 | 0.34 | 0.005 | 0.003 | — | — | Bi: 0.022, Mo: 0.05, B: 0.0018 | 0.857 | Invention Example |
| 12 | 0.022 | 2.55 | 0.04 | — | — | — | 0.004 | Te: 0.0020, Nb: 0.0050 | 0.838 | Invention Example |
| 13 | 0.044 | 3.33 | 0.12 | 0.036 | 0.003 | 0.010 | 0.005 | V: 0.005, Ta: 0.005 | 0.815 | Invention Example |
| 14 | 0.085 | 3.23 | 0.08 | 0.030 | 0.010 | — | — | P: 0.12, Mo: 0.08 | 0.816 | Invention Example |
| 15 | 0.150 | 3.41 | 0.11 | 0.015 | 0.007 | 0.014 | 0.003 | — | 1.653 | Comparative Example |
| 16 | 0.045 | 0.18 | 0.22 | — | — | 0.025 | 0.010 | — | 3.505 | Comparative Example |
| 17 | 0.008 | 3.20 | 1.23 | 0.021 | 0.011 | — | — | — | 1.399 | Comparative Example |

From the steel sheet obtained after the final annealing as mentioned above are cut out 10 specimens with a width of 100 mm in a widthwise direction of the steel sheet under each condition and their iron losses $W_{17/50}$ are measured by a method described in JIS C2556 to determine an average value thereof. The results are also shown in Table 2. As seen from this table, grain-oriented electrical steel sheets being low in the iron loss are obtained under conditions adapted to the invention.

INDUSTRIAL APPLICABILITY

The technique of the invention can be also applied to the control of the texture in steel sheets for automobiles and so on.

The invention claimed is:

1. A method for producing a grain-oriented electrical steel sheet, the method comprising:

hot rolling a raw steel material to obtain a hot rolled steel sheet, the raw steel material including:

C: 0.002-0.10, by mass %,

Si: 2.0-8.0, by mass %,

Mn: 0.005-1.0, by mass %,

Al: 0.010-0.050, by mass %,

N: 0.003-0.020, by mass %, optionally, at least one of Se: 0.003-0.030, by mass %, and S: 0.002-0.03, by mass %, and Fe and inevitable impurities;

optionally, hot band annealing the hot rolled steel sheet;

then, subjecting the hot rolled steel sheet after or without hot band annealing to one stage cold rolling or two or more stage cold rollings including an intermediate annealing therebetween to obtain a cold rolled steel sheet having a final sheet thickness;

subjecting the cold rolled steel sheet to decarburization annealing combined with primary recrystallization annealing, and during the decarburization annealing:

the entire steel sheet is rapidly heated over the entire range of 200-700° C. at an average rate of 50° C./s or more, during the rapid heating, the entire steel sheet is held at a temperature that is within the range of 250-600° C. for 1-10 seconds, and the average heating rate of 50° C./s or more does not include the time during which the entire steel sheet is held at the temperature within the range of 250-600° C. for 1-10 seconds;

then, applying an annealing separator to a surface of the steel sheet; and then, subjecting the steel sheet to a final annealing.

2. A method for producing a grain-oriented electrical steel sheet, the method comprising:

hot rolling a raw steel material to obtain a hot rolled steel sheet, the raw steel material comprising:

C: 0.002-0.10, by mass %,

Si: 2.0-8.0, by mass %,

Mn: 0.005-1.0, by mass %, at least one selected from the group consisting of Se: 0.003-0.030, by mass % and S: 0.002-0.03, by mass %, and Fe and inevitable impurities;

optionally hot band annealing the hot rolled steel sheet;

then, subjecting the hot rolled steel sheet after or without hot band annealing to one stage cold rolling or two or more stage cold rollings including an intermediate annealing therebetween to obtain a cold rolled steel sheet having a final sheet thickness;

subjecting the cold rolled steel sheet to decarburization annealing combined with primary recrystallization annealing, and during the decarburization annealing:

the entire steel sheet is rapidly heated over the entire range of 200-700° C. at an average rate of 50° C./s or more, during the rapid heating, the entire steel sheet is held at a temperature that is within the range of 250-600° C. for 1-10 seconds, and the average heating rate of 50° C./s or more does not include the time during which the entire steel sheet is held at the temperature within the range of 250-600° C. for 1-10 seconds;

then, applying an annealing separator to a surface of the steel sheet; and then, subjecting the steel sheet to a final annealing.

3. The method for producing a grain-oriented electrical steel sheet according to claim 1, wherein the raw steel material further includes one or more selected from the group consisting of:

Ni: 0.010-1.50, by mass %,

Cr: 0.01-0.50, by mass %,

Cu: 0.01-0.50, by mass %,

P: 0.005-0.50, by mass %,

Sb: 0.005-0.50, by mass %,

Sn: 0.005-0.50, by mass %,

Bi: 0.005-0.50, by mass %,

Mo: 0.005-0.100, by mass %,

B: 0.0002-0.0025, by mass %,

Te: 0.0005-0.0100, by mass %,

Nb: 0.0010-0.0100, by mass %,

V: 0.001-0.010, by mass %, and

Ta: 0.001-0.010, by mass %.

4. The method for producing a grain-oriented electrical steel sheet according to claim 1, wherein during the decarburization annealing:

during the rapid heating, the entire steel sheet is held at the temperature that is within the range of 250-600° C. for 1-5 seconds, and the average heating rate of 50° C./s or more does not include the time during which the entire steel sheet is held at the temperature within the range of 250-600° C. for 1-5 seconds.

5. The method for producing a grain-oriented electrical steel sheet according to claim 2, wherein the raw steel material further includes one or more selected from the group consisting of:

Ni: 0.010-1.50, by mass %,

Cr: 0.01-0.50, by mass %,

Cu: 0.01-0.50, by mass %,

P: 0.005-0.50, by mass %,

Sb: 0.005-0.50, by mass %,

Sn: 0.005-0.50, by mass %,

Bi: 0.005-0.50, by mass %,

Mo: 0.005-0.100, by mass %,

B: 0.0002-0.0025, by mass %,

Te: 0.0005-0.0100, by mass %,

Nb: 0.0010-0.0100, by mass %,

V: 0.001-0.010, by mass %, and

Ta: 0.001-0.010, by mass %.

6. The method for producing a grain-oriented electrical steel sheet according to claim 2, wherein during the decarburization annealing:

during the rapid heating, the entire steel sheet is held at the temperature that is within the range of 250-600° C. for 1-5 seconds, and the average heating rate of 50° C./s or more does not include the time during which the entire steel sheet is held at the temperature within the range of 250-600° C. for 1-5 seconds.

* * * * *